US005439114A

United States Patent [19]

Lingle et al.

[11] Patent Number: 5,439,114

[45] Date of Patent: Aug. 8, 1995

[54] APPARATUS FOR SUPPORTING AN ARTICLE WITHIN A CONTAINER

[75] Inventors: John E. Lingle, Brookfield; David B. Stucker, Hartford; James E. Pawlik, Kenosha, all of Wis.

[73] Assignee: Stone Container Corporation, Chicago, Ill.

[21] Appl. No.: 105,306

[22] Filed: Aug. 11, 1993

[51] Int. Cl.[6] ..... B65D 81/02; B65D 5/28

[52] U.S. Cl. ..... 206/586; 206/592; 206/594; 220/532; 229/198

[58] Field of Search ..... 206/586, 588, 591, 592, 206/594, 521; 229/198; 220/532

[56] References Cited

U.S. PATENT DOCUMENTS

| | | | |
|---|---|---|---|
| 1,682,410 | 8/1928 | Oppenheim | 206/594 X |
| 1,840,677 | 1/1932 | Miessler | 206/594 X |
| 2,160,816 | 6/1939 | Barnes | 206/591 X |
| 2,257,536 | 9/1941 | Roycroft | 220/532 X |
| 2,260,181 | 10/1941 | Hollingsworth | 206/594 X |
| 2,401,765 | 6/1946 | Kuhlman | 206/594 X |
| 2,784,895 | 3/1957 | Linwood, Jr. et al. | 229/198 X |
| 3,047,137 | 7/1962 | Kindseth | 206/592 |
| 3,146,932 | 9/1964 | Mayer | 206/591 X |
| 3,986,657 | 10/1976 | Angelini | 229/198 X |
| 4,463,895 | 8/1984 | Pasquale | 229/198 X |
| 5,226,543 | 7/1993 | Foos et al. | 206/592 |

FOREIGN PATENT DOCUMENTS

| | | | |
|---|---|---|---|
| 0258579 | 10/1990 | Japan | 206/592 |

*Primary Examiner*—Bryon P. Gehman
*Attorney, Agent, or Firm*—Dick and Harris

[57] ABSTRACT

An apparatus for supporting an article in shock-isolating, spaced relation to the walls of a container is provided. A support wall and a plurality of lateral support members define a partial enclosure for receiving the article. Corner support members secure the support wall and the lateral support members in the configuration defining the enclosure. Spacer support members extend from the lateral support members to position the article receiving enclosure in spaced relation away from the walls, the top and the bottom of the container, to provide shock-isolation for protecting the article supported, capped and at least partially received by the apparatus.

20 Claims, 1 Drawing Sheet

APPARATUS FOR SUPPORTING AN ARTICLE WITHIN A CONTAINER

BACKGROUND OF THE INVENTION

The present invention relates to packing and packaging apparatus for protecting articles which are placed within containers, such as standard paperboard boxes.

Typically, when fragile items, such as electronic appliances and the like, are transported, for example during the manufacturing process, or from the manufacturer to the distributor or retailer, the items are shipped in paperboard boxes. The boxes will have internal dimensions greater than the external dimensions of the article being shipped so that packing material may be placed around the item, in order to isolate the item from shock which may result during rough handling or incidents during shipping. A typical packing method involves the use of inserts made of polystyrene foam, which may be either affixed to paperboard support members, or which may be formed so as to partially surround and conform to the contours of the article being packed.

Although preformed polystyrene foam may provide protection from shock, the use of such preformed foam inserts has certain potential drawbacks. Specially formed inserts may be time-consuming to fit onto the article(s), which is a potential disadvantage, if the speed of the packaging process is important. In addition, polystyrene foam is not an ecologically advantageous material, since it does not biodegrade, is not made from recycled materials and is, itself, not easily recycled.

Accordingly, it would be desirable to provide an apparatus for packaging fragile articles so that they are well protected against shock, but which does not utilize polystyrene foam inserts.

A potential substitute material for providing shock isolation packaging is corrugated paperboard. Corrugated paperboard is less expensive than polystyrene foam, and is believed to be less of a potential fire hazard, which is a significant consideration when large quantities of packages are stored in a warehouse environment. In addition, corrugated paperboard may be shipped in flat form and folded into operational configuration at the point of use, thus leading to lower shipping and storage costs.

Accordingly, it is an object of the invention to provide an apparatus for supporting an article within a container which is a suitable substitute for extruded polystyrene foam inserts.

It is a further object of the invention to provide a packaging apparatus which is readily and easily constructed and easily packed and unpacked, with the article to be protected, within a container.

Another object of the invention is to provide a packaging apparatus, configured from an environmentally appropriate material, which can provide shock protection of equal effectiveness to polystyrene foam inserts.

These and other objects of the invention will become apparent in light of the present specification, claims and drawings.

SUMMARY OF THE INVENTION

The present invention is directed to an apparatus for supporting and positioning an article within an enclosing container, in which the container has one or more base walls with a plurality of side edges and a plurality of side walls intersecting with and extending away from the one or more base walls. The invention supports the article in shock-isolating spaced orientation relative to the one or more base walls and the side walls. It comprises a support wall, having a plurality of side edges; a plurality of lateral support means operably emanating from the support wall and arranged adjacent to at least two of the side edges, with the lateral support means being operably arrangeable relative to the support wall, so as to adjoin and extend away from the support wall, so as to define an article receiving enclosure; corner support means operably associated with the lateral support means, for engaging and maintaining the lateral support means in articulation relative to the support wall defining the article receiving enclosure; and spacer support means, operably emanating from at least one of the plurality of lateral support means for engaging at least one of the one or more base walls and at least one of the side walls of the container, when an article is placed within the article receiving enclosure and the article and apparatus are placed within the container, for maintaining the support wall in the spaced relation to the at least one base wall and the side walls of the container. The apparatus spaces, cushions and maintains the position of at least a portion of the article relative to the enclosing container base wall and side walls.

Each of the plurality of lateral support means is a support flap member operably emanating from a fold at one of the side edges of the support wall, with each the spacer support means comprising a spacer flap member operably emanating from the support flap member at a position opposite to the side edge of the support wall.

The lateral support means includes at least two support flap members positioned adjacent one another, and the at least one corner support means comprises at least one corner support flap operably emanating at a fold from at least one of the at least one lateral support flap member, with the at least one corner support flap being positionable relative to the one of the at least one lateral support flap member so as to be capable of overlying at least a portion of the adjacent lateral support flap member. The corner support means further includes means for affixing the at least one corner flap to the adjacent lateral support flap member.

In a preferred embodiment of the invention, the means for affixing the at least one corner support flap comprises a staple. In an alternative embodiment of the invention, the means for affixing the at least one corner support flap comprises an adhesive.

Each of the spacer flap members emanates from the respective lateral support flap member, so as to extend toward a linear intersection of at least one of the base walls and one of the side walls of the container, with the at least one spacer support flap being retained in the position, when one or more of the apparatus and the article are placed within the container.

In a preferred embodiment of the invention, the support wall, the plurality of lateral support means, the corner support means and the spacer support means are all formed as part of a single contiguous sheet of paper material, in particular, corrugated paperboard material.

The enclosing container may be a substantially right rectangular parallelepiped having a rectangular bottom base wall, a rectangular top base wall positioned opposite to the bottom base wall, and four side walls, substantially perpendicularly intersecting and extending between the base walls, and arranged in opposed parallel pairs. The apparatus therefore will include an apparatus support wall having a substantially rectangular configuration, the side edges including first and second side edges, and first and second end edges, the first and second side edges being operably arranged substantially perpendicularly to the first and second end edges; the lateral support means including first and second side support means operably arranged adjacent to and emanating from the first and second side edges, respectively, and first and second end support means operably arranged adjacent to and emanating from the first and second end edges, respectively, in which the first and second side support means, and the first and second end support means are articulable relative to the support wall, and extend away from the support wall, to define the article receiving enclosure therewith. The corner support means will include at least two corner support means each operably positioned between adjacent respective ones of the first and second side support means and the first and second end support means, and operably engageable therewith, to maintain the first and second side support means, and the first and second end support means in the articulated position relative to the support wall to further secure the article within the defined receiving enclosure. The spacer support means are operably associated with at least one pair of the first and second side support means and the first and second end support means, for engaging at least the base wall and at least two of the four side walls of the container, when an article is placed within the article receiving enclosure, and the apparatus is placed within the container, for maintaining the support wall in spaced relation to the base wall and the four side walls of the container.

The first and second side support means extend away from the apparatus support wall, and have an included angle therebetween of between 90 and 150 degrees. Likewise, the first and second end support means extend away from the apparatus support wall, and have an included angle therebetween of between 90 and 150 degrees.

The first and second side support means comprise first and second side flap members operably emanating from the first and second side edges, respectively, of the support wall, and each of the first and second side flap members are formed contiguously with the support wall, with each of the first and second side flap members having a substantially rectangular configuration.

The first and second end support means have first and second end flap members operably emanating from the first and second end edges, respectively, of the support wall, with each of the first and second end flap members being formed contiguously with the support wall.

Each of the first and second end flap members has a substantially trapezoidal configuration.

The at least one corner support means comprises at least one corner support flap contiguously formed with one pair of the first or second side support means and the first or second end support means, in which the at least one corner support flap is positionable so as to be capable of overlying at least a portion of the corresponding one of the first or second end support means or the first or second side support means, respectively; and further including for affixing the at least one corner support flap to the corresponding one of the first or second end support means or the first or second side support means.

In a preferred embodiment, the support wall is provided with one or more apertures therein for accommodating elements which may irregularly project outwardly away from the article.

An alternative embodiment further includes at least one aperture operably arranged in said support wall for operably receiving and aligning a corresponding auxiliary support means operably positionable between at least one of the support wall and a bottom wall of the article, and the support wall and the bottom base wall of the container.

The invention also includes a first said apparatus for supporting and positioning an article within an enclosing container being oriented in an open upright position, and having one of the articles placed within the article receiving enclosure thereof, with a second apparatus for supporting and positioning an article within an enclosing container, being inverted and placed upon the top of article, the two apparatus for supporting and positioning an article within an enclosing container, and said article therebetween being placed within one of containers, for spacing, cushioning and maintaining the position of at least a portion of the article relative to the enclosing container base wall and side walls thereof.

DETAILED DESCRIPTION OF THE DRAWINGS

Figure 1:
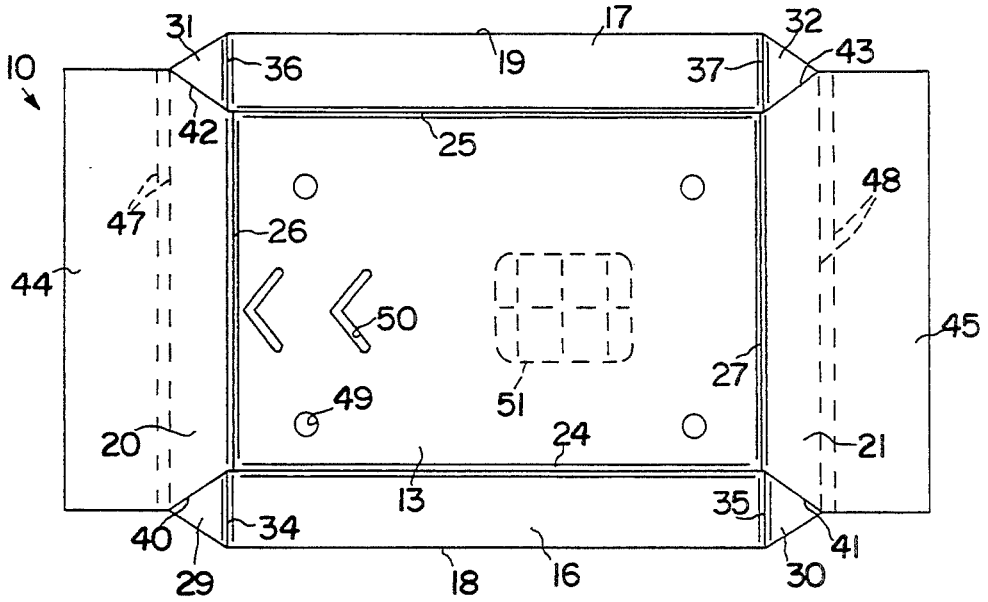
FIG. 1 is a top plan view of the apparatus for supporting an article within a container, according to the present invention, in the form of an unfolded flat blank.

While the present invention is susceptible of embodiment in many different forms, there is shown in the drawings and will be described herein in detail, a specific embodiment, with the understanding that the present disclosure is to be considered as an exemplification of the principles of the invention, and is not intended to limit the invention to the embodiment illustrated.

Article support apparatus 10 is displayed in FIG. 1, in its unarticulated form, as a flat, substantially rectangular blank of carton material, such as corrugated paperboard. The blank which forms article support apparatus 10 includes support wall 13, and lateral support members including side support members 16 and 17, and end support members 20 and 21. Side support members 16 and 17 emanate contiguously from support wall 13. Fold lines 24 and 25, respectively, extend along the common edges of side support members 16 and 17, and support wall 13, respectively. Similarly, end support members 20 and 21 emanate contiguously from support wall 13, and fold lines 26 and 27 extend along the common edges of end support members 20 and 21, and support wall 13, respectively.

Substantially triangular corner support members 29 and 30 are contiguously formed at the ends of side support member 16. Fold lines 34 and 35 extend along the common edges of corner support members 29 and 30, and side support member 16. Corner support members 29 and 30 are separated from end support members 20 and 21, respectively, by cuts 40 and 41, respectively. Substantially triangular corner support members 31 and 32 are contiguously formed with side support member 17. Fold lines 36 and 37 extend along the common edges of corner support members 31 and 32, and side support member 17. Spacer support members 44 and 45 are contiguously formed with end support members 20 and 21, respectively. Fold/break lines 47 and 48 extend along the common edges of spacer support members 44 and 45, and end support members 20 and 21, respectively.

As the article which is to be supported by apparatus 10 may have irregularities projecting from the surface which is to be in direct contact with support wall 13, apertures may be provided, such as apertures 49–51, to accommodate such features as the feet of an appliance (aperture 48), or a projecting element of the apparatus (aperture 51). Apertures 50 may also be used to accommodate auxiliary support means (not shown) which may fit either between the article being packed, and support wall 13, or between support wall 13 and bottom wall 68 (see FIG. 3) of container 62. Such auxiliary support means may be needed to provide additional localized support required due to an irregularly shaped or weighted article being packed.

Figure 2:
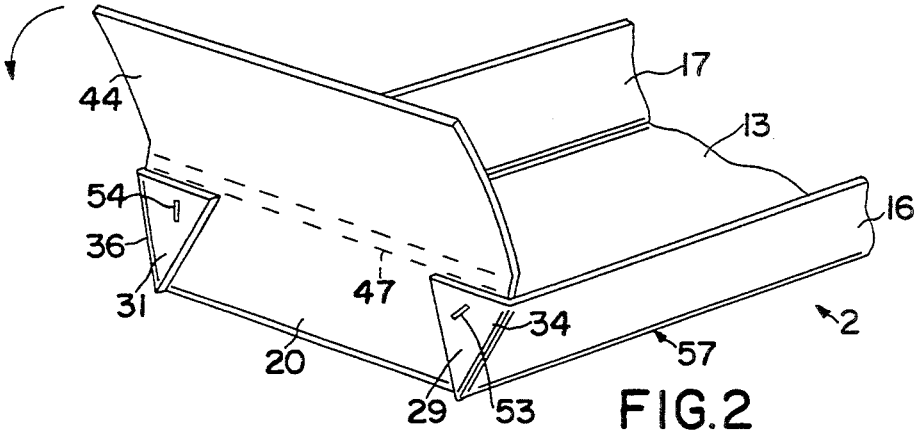
FIG. 2 is a fragmentary perspective end view of the apparatus according to FIG. 1, in partially folded and assembled configuration.

Article support apparatus 10 is shown in FIG. 2 in folded, partially assembled configuration. Apertures 49–51 have been omitted for clarity of illustration. When apparatus 10 is assembled, end support members 20 and 21 are folded upward (toward the viewer, as apparatus 10 is viewed in FIG. 1). Side support members 16 and 17 are then likewise folded in the same direction. Once side support members 16 and 17, and end support members 20, and 21 (not shown) have been folded upward out of the plane of support wall 13, they are held together by corner support members 29–32, respectively, which are folded to overlap, as indicated by the arrow, end support member 20 and end support member 21 (not shown). In order to secure the side support members 16 and 17 in place with end support members 20 and 21, means for affixing corner support members 29 to 32 in position may be employed, such as staples 53 and 54. In the alternative, a suitable adhesive may be used. Once corner support members 29–32 have been fixed into place, end support members 20, 21, side support members 16, 17 and support wall 13 define a tray portion or partial enclosure 57 for receiving the article to be packaged. In a preferred embodiment of the invention, side support members 16 and 17 intersect support wall 13, with an included angle between either of side support members 16 or 17, and support wall 13, of between 90 and approximately 150 degrees. The angle between end support walls 20 or 21, and support wall 13 in a preferred embodiment approaches 90 degrees, but may be as much as 150 degrees.

Figure 3:
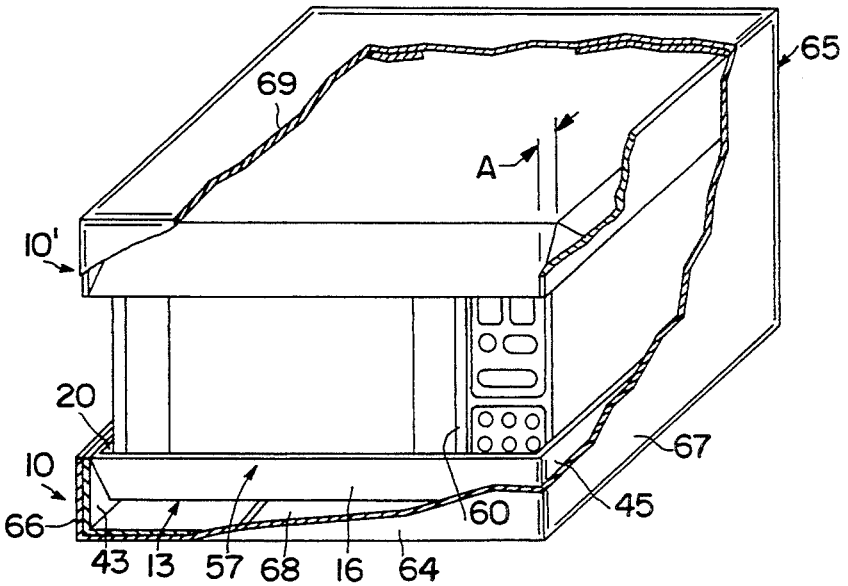
FIG. 3 is a side perspective view, partially in section, of a container having an article packed therein, employing two of the packing apparatus according to FIG. 1.

An example of a completely packaged article is shown in cutaway view in FIG. 3. Article 60, which may be, for example, a microwave oven, is shown seated within tray portion 57 of article support apparatus 10. A second article support apparatus 10' has been placed atop article 60. Article 60 and article support apparatus 10, 10' are all enclosed within container 62, which may be an otherwise conventional paperboard box. Container 62 includes front wall 64, rear wall 65 side walls 66 and 67, bottom wall 68 and top wall 69.

The distance between fold lines 26 and 27 is configured to be slightly greater than the outside width of article 60. Likewise, the distance between fold lines 24 and 25 is configured to be slightly greater than the front-to-back depth of article 60, excluding any minor, irregular projections. When end support members 20 and 21 are folded up, and secured in place as shown in FIG. 2, preferably they occupy a substantially perpendicular relationship, relative to support wall 13. When side support members 16 and 17 are folded up, and secured in the configuration indicated in FIG. 2, side support members 16 and 17 make oblique angles relative to support wall 13, so that outer edges 18 and 19 are substantially farther apart than are fold lines 24 and 25. Spacer support members 44 and 45 are then folded along fold/break lines 47 and 48 and are positioned substantially overlying end support members 20 and 21. However, because spacer support members 44 and 45 have heights (in the direction perpendicular to fold/-break lines 47 and 48) which are greater than the heights of end support members 20 and 21, spacer support members 44 and 45 extend below support wall 13, when folded down to substantially overlap end support members 20 and 21, respectively. In a preferred embodiment of the invention, the distance between the outer surfaces of spacer members 44 and 45, when in the configuration shown in FIG. 3, is intended to be substantially equal to the interior distance between side walls 66 and 67 of container 62, such that article tray apparatus 10 is closely received within container 62, with respect to the distance between side walls 66 and 67. In this manner, because of the difference in height between spacer support members 44, 45 and end support members 20, 21, support wall 13 is elevated up above bottom wall 68 of container 62. Cushioning at the sides of article 60 is provided by three layers of corrugated material, namely, on the left (as seen in FIG. 3), side wall 66, spacer support member 44 and end support member 20, and on the right by side wall 67, spacer support member 45 and end support member 21 (not shown). Protection from front-to-back is provided by the fact that since support wall 13 of tray portion 57 is configured to be substantially equal to the general side configuration of article 60, article 60 will tend to be centered and nested within tray portion 57. However, the front to back dimensions of container 62, from front wall 64 to rear wall 65 are configured to be greater than the front-to-back depth of article 60. However, the distance between outer edge 18 and outer edge 19 of tray apparatus 10 is configured to be substantially equal to the interior distance between front wall 64 and rear wall 65, so that a clearance A will be provided between the front of article 60 and the interior face of front wall 64, due to the oblique angle made by side support member 16 relative to support wall 13. A similar clearance (not shown) will be provided between the rear of article 60 and the interior face of rear wall 65 of container 62.

To complete the packaging process, a second article support apparatus 10' is placed in inverted position upon the top of article 60. The second article support apparatus 10' will be configured substantially similar to the first apparatus 10, presuming that article 60 is a substantially regular object, with all rectangular sides, such that the spacer support members and side support members will contact the walls of container 62 in the manner previously described so that article 60 will be completely suspended with clearance between the bottom of article 60 and bottom wall 68 of container 62 and with clearance between the top of article 60 and the top wall 69 of container 62. In addition, on the sides of article 60, multiple layers of shockabsorbing corrugated material will be positioned between article 60 and the side walls of container 62, and article 60 will further be suspended with clear space between the front and back surfaces of article 60 and the front and rear walls of container 62.

It is believed that an article packaged using the previously described apparatus will obtain a level of shock isolation protection equal to and possibly greater than a similar article wrapped and packaged with polystyrene foam pads in between the article and the walls of the container. In addition, the present invention features the advantages of lower costs of manufacture, the ability to be manufactured from recycled materials and to, in turn, be further recycled, and reduced shipping and storage costs prior to use, since the apparatus can be originally shipped as a simple flat corrugated blank.

While the foregoing description shows an article support apparatus configured for use with only vertical end support members, and thus only two spacer support members, an alternative construction could provide for both vertical side support members and vertical end support members, so that both the sides and the ends could be provided with spacer support members along all four sides of the article.

In addition, the present invention may be adapted to articles and containers with other than substantially rectangular cross-sections. For example, for an article having a triangular cross-section, a shipping container having a similar triangular cross-section may be employed. In such instance, the support wall of the apparatus would be triangular in configuration with lateral support members emanating from the sides of the triangular support wall, and spacer support members further emanating from the lateral support members. So long as the spacer support members are substantially symmetrically arranged about the support wall, each side of the article can either be suspended in spaced relation from the adjacent container wall, or be protected by layers of corrugated material comprising side support members and spacer support members.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. An apparatus, in combination with an enclosing container and an article, for supporting and positioning said article, when said apparatus and said article are placed within said enclosing container, said container having one or more base walls, each with a plurality of side edges, and a plurality of side walls intersecting with and extending away from said one or more base walls, from positions substantially along said side edges of said one or more base walls, for supporting and positioning said article within said container in shock-isolating spaced orientation relative to said one or more base walls and said side walls, said apparatus comprising:

a support wall, having a plurality of side edges;

a plurality of lateral support means operably emanating from said support wall and arranged adjacent to said side edges, so as to substantially surround said support wall, said lateral support means being operably arranged relative to said support wall, so as to adjoin and extend away from said support wall, so as to define an open, article receiving enclosure, at least one of said lateral support means having a distal edge operably disposed in spaced relation to a respective one of said side edges of said support wall, at least one corner support means operably associated with said lateral support means, for engaging and maintaining said lateral support means in articulation relative to said support wall defining said article receiving enclosure; and spacer support means, operably emanating from said distal edge of said at least one lateral support means, and positionable so as to extend substantially adjacent to said respective lateral support means, beyond said support wall, when said apparatus is in said container, and so as to operably dispose said spacer support means in a load-bearing relationship relative to one of said one or more base walls and said support wall, to maintain said support wall and said respective lateral support means in spaced relation to said one of said one or more base walls of said container, and to engage at least one of said one or more base walls and at least one of said side walls of said container, when said article is placed within said article receiving enclosure and said article and apparatus are placed within said container, said spacer support means further being positionable between said at least one lateral support means and one of said one or more side walls of said container, so as to maintain said support wall in spaced relation to one of said one or more side walls of said container, said apparatus maintaining said article placed in said article receiving enclosure in spaced relation to said one or more base walls and side walls of said enclosing container.

2. The combination according to claim 1 wherein said one or more of said plurality of lateral support means comprises at least one lateral support member operably emanating from a fold at one of said side edges of said support wall, and each said spacer support means comprises a spacer support member operably emanating from said at least one lateral support member at a position opposite to said side edge of said support wall.

3. The combination according to claim 2, wherein said lateral support means includes at least two lateral support members positioned adjacent one another, and said at least one corner support means comprises at least one corner support member operably emanating at a fold from at least one of said at least two lateral support members, said at least one corner support member being positionable relative to said one of said at least one lateral support member so as to be capable of overlying at least a portion of said adjacent lateral support member;

said corner support means further including means for affixing said at least one corner support member to said adjacent lateral support member.

4. The combination according to claim 3, wherein said means for affixing said at least one corner support member comprises a staple.

5. The combination according to claim 3, wherein said means for affixing said at least one corner support member comprises an adhesive.

6. The combination according to claim 2 wherein each said spacer support member emanates from a fold at said distal edge, and includes a support edge disposed distal to said fold such that upon placement of said apparatus in said container, each said spacer support member is folded over to a position adjacent to and between a respective one of said at least one lateral support member and one of said side walls of said container, said support edge of said spacer support member being disposed substantially adjacent to one of said edges of said base wall.

7. The combination according to claim 1, wherein said support wall, said plurality of lateral support means, said corner support means and said spacer support means are all formed as part of a single contiguous sheet of paper material.

8. The combination according to claim 1, wherein said apparatus is formed of corrugated paperboard material.

9. The combination according to claim 1, wherein said enclosing container is a substantially right rectangular parallelepiped having a rectangular bottom base wall, a rectangular top base wall positioned opposite to said bottom base wall, and four side walls, substantially perpendicularly intersecting and extending between said base walls, and arranged in opposed parallel pairs;

said support wall having a substantially rectangular configuration, said side edges of said support wall including first and second side edges, and first and second end edges, said first and second side edges being operably arranged substantially perpendicularly to said first and second end edges;

said lateral support means including first and second side support means operably arranged adjacent to and emanating from said first and second side edges, respectively, and first and second end support means operably arranged adjacent to and emanating from said first and second end edges, respectively, said first and second side support means, and said first and second end support means being articulable relative to said support wall, and extending away from said support wall, to define said article receiving enclosure therewith;

said corner support means including at least two corner support means each operably positioned between adjacent respective ones of said first and second side support means and said first and second end support means, and operably engageable therewith, to maintain said first and second side support means, and said first and second end support means in said articulated position relative to said support wall to further secure said article within said article receiving enclosure; and said spacer support means operably associated with at least one pair of said first and second side support means and said first and second end support means, for engaging at least said base wall and at least two of said four side walls of said container, when said article is placed within said article receiving enclosure, and said apparatus is placed within said container, for maintaining said support wall in spaced relation to said base wall and said four side walls of said container.

10. The combination according to claim 9, wherein said first and second side support means extend away from said support wall, and such that an included angle of between 90 and 150 degrees is provided between each of said first and second side support means and said support wall, respectively, and said first and second end support means extend away from said support wall, and such that an included angle of between 90 and 150 degrees is provided between each of said first and second end support means and said support wall, respectively.

11. The combination according to claim 9 wherein said first and second side support means comprise:

first and second side support members operably emanating from said first and second side edges, respectively, of said support wall, each of said first and second side support members being formed contiguously with said support wall, each of said first and second side support members having a substantially rectangular configuration.

12. The combination according to claim 9 wherein said first and second end support means comprise:

first and second end support members operably emanating from said first and second end edges, respectively, of said support wall, each of said first and second end support members being formed contiguously with said support wall, each of said first and second end support members having a substantially trapezoidal configuration.

13. The combination according to claim 9 wherein said at least one corner support means comprises:

corner support member contiguously formed with one pair of said first or second side support means and said first or second end support means, said at least one corner support member being positionable so as to be capable of overlying at least a portion of said corresponding one of said first or second end support means or said first or second side support means, respectively; and means for affixing said at least one corner support member to said corresponding one of said first or second end support means or said first or second side support means.

14. The combination according to claim 1, wherein said support wall is provided with one or more apertures therein for accommodating elements which may irregularly project outwardly away from said article.

15. A pair of apparatus, in combination with an enclosing container and an article, for supporting and positioning said article, when said apparatus and said article are placed within said enclosing container, said container having one or more base walls, each with a plurality of side edges, and a plurality of side walls intersecting with and extending away from said one or more base walls, from positions substantially along said side edges of said one or more base walls, for supporting and positioning said article within said container in shock-isolating spaced orientation relative to said one or more base walls and said side walls, each said apparatus comprising:

a support wall, having a plurality of side edges;

a plurality of lateral support means operably emanating from said support wall and arranged adjacent to said side edges, so as to substantially surround said support wall, said lateral support means being operably arranged relative to said support wall, so as to adjoin and extend away from said support wall, so as to define an open, article receiving enclosure, at least one of said lateral support means having a distal edge operably disposed in spaced relation to a respective one of said side edges of said support wall, at least one corner support means operably associated with said lateral support means, for engaging and maintaining said lateral support means in articulation relative to said support wall defining said article receiving enclosure; and spacer support means, operably emanating from said distal edge of said at least one lateral support means, and positionable so as to extend substantially adjacent to said respective lateral support means, beyond said support wall, when said apparatus is in said container, and so as to operably dispose said spacer support means in a load-bearing relationship relative to one of said one or more base walls and said support wall, to maintain said support wall and said lateral support means in spaced relation to said one of said one or more base walls of said container, and to engage at least one of said one or more base walls and at least one of said side walls of said container, when said article is placed within said article receiving enclosure and said article and apparatus are placed within said container, said spacer support means further being positionable between said at least one lateral support means and one of said one or more side walls of said container, so as to maintain said support wall in spaced relation to one of said one or more side walls of said container, said apparatus maintaining said article placed in said article receiving enclosure in spaced relation to said one or more base walls and side walls of said enclosing container, a first of said pair of apparatus being oriented in an open upright position, in a container and having said article placed within the article receiving enclosure thereof, with a second of said apparatus being inverted and placed upon the top of said article, said two apparatus and said article therebetween being placed within said container, for spacing, cushioning and maintaining the position of at least a portion of said article relative to said enclosing container base wall and side walls thereof.

16. An apparatus, in combination with an enclosing container and an article, for supporting and positioning said article, when said apparatus and said article are placed within said enclosing container, said container having one or more base walls, each with a plurality of side edges and a plurality of side walls intersecting with and extending away from said one or more base walls, from positions substantially along said side edges of said one or more base walls, for supporting and positioning said article within said container in shock-isolating spaced orientation relative to said one or more base walls and said side walls, said apparatus comprising:

a support wall, having a plurality of side edges;

a plurality of lateral support means operably emanating from said support wall and arranged adjacent to said side edges, so as to substantially surround said support wall, said lateral support means being operably arranged relative to said support wall, so as to adjoin and extend away from said support wall, so as to define an open-article receiving enclosure, at least one of said lateral support means having a distal edge operably disposed in spaced relation to a respective one of said side edges of said support wall, at least one corner support means operably associated with said lateral support means, for engaging and maintaining said lateral support means in articulation relative to said support wall defining said article receiving enclosure; and spacer support means, operably emanating from said distal edge of said at least one lateral support means, and positionable so as to extend substantially adjacent to said respective lateral support means, beyond said support wall, when said apparatus is in said container, so as to maintain said support wall in spaced relation to one of said one or more base walls of said container, and to engage at least one of said one or more base walls and at least one of said side walls of said container, when said article is placed within said article receiving enclosure and said article and apparatus are placed within said container, said spacer support means further being positionable between said at least one lateral support means and one of said one or more side walls of said container, so as to maintain said support wall in spaced relation to one of said one or more side walls of said container, said apparatus maintaining said article placed in said article receiving enclosure in spaced relation to said one or more base walls and side walls of said enclosing container;

one or more of said plurality of lateral support means comprising at least one lateral support member operably emanating from a fold at one of said side edges of said support wall, and each said spacer support means comprising a spacer support member operably emanating from said at least one lateral support member at a position opposite to said side edge of said support wall, said lateral support means including at least two lateral support flap members positioned adjacent one another;

said at least one corner support means including at least one corner support member operably emanating at a fold from at least one of said at least two lateral support members, said at least one corner support member being positionable relative to said one of said at least one lateral support member so as to be capable of overlying at least a portion of said adjacent lateral support member;

said corner support means further including means for affixing said at least one corner support member to said adjacent lateral support member.

17. The combination according to claim 16, wherein said means for affixing said at least one corner support member comprises a staple.

18. The combination according to claim 16, wherein said means for affixing said at least one corner support member comprises an adhesive.

19. An apparatus, in combination with an enclosing container and an article, for supporting and positioning said article, when said apparatus and said article are placed within said enclosing container, said container having one or more base walls, each with a plurality of side edges and a plurality of side walls intersecting with and extending away from said one or more base walls, from positions substantially along said side edges of said one or more base walls, for supporting and positioning said article within said container in shock-isolating spaced orientation relative to said one or more base walls and said side walls, said apparatus comprising:

a support wall, having a plurality of side edges;

a plurality of lateral support means operably emanating from said support wall and arranged adjacent to said side edges, so as to substantially surround said support wall, said lateral support means being operably arranged relative to said support wall, so as to adjoin and extend away from said support wall, so as to define an open article receiving enclosure, at least one of said lateral support means having a distal edge operably disposed in spaced relation to a respective one of said side edges of said support wall, at least one corner support means operably associated with said lateral support means, for engaging and maintaining said lateral support means in articulation relative to said support wall defining said article receiving enclosure; and spacer support means, operably emanating from said distal edge of said at least one lateral support means, and positionable so as to extend substantially adjacent to said respective lateral support means, beyond said support wall, when said apparatus is in said container, so as to maintain said support wall in spaced relation to one of said one or more base walls of said container, and to engage at least one of said one or more base walls and at least one of said side walls of said container, when said article is placed within said article receiving enclosure and said article and apparatus are placed within said container, said spacer support means further being positionable between said at least one lateral support means and one of said one or more side walls of said container, so as to maintain said support wall in spaced relation to one of said one or more side walls of said container, said apparatus maintaining said article placed in said article receiving enclosure in spaced relation to said one or more base walls and side walls of said enclosing container;

one or more of said plurality of lateral support means including at least one lateral support member operably emanating from a fold at one of said side edges of said support wall, and each said spacer support means including a spacer support member operably emanating from said at least one lateral support member at a position opposite to said side edge of said support wall, each said spacer support member emanating from a fold at said distal edge of said respective at least one lateral support member, and including a support edge disposed distal to said fold such that upon placement of said apparatus in said container, each said spacer support member is folded over to a position adjacent to and between a respective one of said at least one lateral support member and one of said side walls of said container, said support edge of said spacer support member being disposed substantially adjacent to one of said side edges of said base wall.

20. An apparatus, in combination with an enclosing container and an article, for supporting and positioning said article, when said apparatus and said article are placed within said enclosing container, said container being a substantially right rectangular parallelepiped having a rectangular bottom base wall, a rectangular top base wall positioned opposite to said bottom base wall, and four side walls, substantially perpendicularly intersecting and extending between said base walls, and arranged in opposed parallel pairs, said apparatus supporting and positioning said article within said container in shock-isolating spaced orientation relative to said one or more base walls and said side walls, said apparatus comprising:

a support wall, having a plurality of side edges;

a plurality of lateral support means operably emanating from said support wall and arranged adjacent to said side edges, so as to substantially surround said support wall, said lateral support means being operably arranged relative to said support wall, so as to adjoin and extend away from said support wall, so as to define an open article receiving enclosure, at least one of said lateral support means having a distal edge operably disposed in spaced relation to a respective one of said side edges of said support wall, at least one corner support means operably associated with said lateral support means, for engaging and maintaining said lateral support means in articulation relative to said support wall defining said article receiving enclosure; and spacer support means, operably emanating from said distal edge of said at least one lateral support means, and positionable so as to extend substantially adjacent to said respective lateral support means, beyond said support wall, when said apparatus is in said container, so as to maintain said support wall in spaced relation to one of said one or more base walls of said container, and to engage at least one of said one or more base walls and at least one of said side walls of said container, when said article is placed within said article receiving enclosure and said article and apparatus are placed within said container, said spacer support means further being positionable between said at least one lateral support means and one of said one or more side walls of said container, so as to maintain said support wall in spaced relation to one of said one or more side walls of said container, said apparatus maintaining said article placed in said article receiving enclosure in spaced relation to said one or more base walls and side walls of said enclosing container, said support wall having a substantially rectangular configuration, said side edges of said support wall including first and second side edges, and first and second end edges, said first and second side edges being operably arranged substantially perpendicularly to said first and second end edges;

said lateral support means including first and second side support means operably arranged adjacent to and emanating from said first and second side edges, respectively, and first and second end support means operably arranged adjacent to and emanating from said first and second end edges, respectively, said first and second side support means, and said first and second end support means being articulable relative to said support wall, and extending away from said support wall, to define said article receiving enclosure therewith;

said corner support means including at least two corner support means each operably positioned between adjacent respective ones of said first and second side support means and said first and second end support means, and operably engageable therewith, to maintain said first and second side support means, and said first and second end support means in said articulated position relative to said support wall to further secure said article within said article receiving enclosure; and said spacer support means operably associated with at least one pair of said first and second side support means and said first and second end support means, for engaging at least said base wall and at least two of said four side walls of said container, when said article is placed within said article receiving enclosure, and said apparatus is placed within said container, for maintaining said support wall in spaced relation to said base wall and said four side walls of said container, said corner support means including at last one corner support member contiguously formed with one pair of said first or second side support means and said first or second end support means, said at least one corner support member being positionable so as to be capable of overlying at least a portion of said corresponding one of said first or second end support means or said first or second side support means, respectively; and means for affixing said at least one corner support member to said corresponding one of said first or second end support means or said first or second side support means.

* * * * *